US006709286B1

(12) United States Patent
Korsunsky et al.

(10) Patent No.: US 6,709,286 B1
(45) Date of Patent: Mar. 23, 2004

(54) ELECTRICAL CONNECTOR

(75) Inventors: Iosif R. Korsunsky, Harrisburg, PA (US); Chong H. Yi, Mechanicsburg, PA (US); Tod M. Harlan, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/318,883

(22) Filed: Dec. 12, 2002

Related U.S. Application Data

(60) Provisional application No. 60/416,331, filed on Oct. 3, 2002.

(51) Int. Cl.[7] ..... H01R 13/73

(52) U.S. Cl. ..... 439/557; 439/95; 439/939; 439/607

(58) Field of Search ..... 439/557, 607, 439/79, 939, 108

(56) References Cited

U.S. PATENT DOCUMENTS 3,052,865 A * 9/1962 Pappano et al. ..... 439/545
6,033,263 A * 3/2000 Weidler et al. ..... 439/620
6,206,731 B1 * 3/2001 Kuo ..... 439/610
6,231,384 B1 * 5/2001 Kuo ..... 439/545
6,328,578 B1 * 12/2001 Gilliland et al. ..... 439/95

* cited by examiner

*Primary Examiner*—Hien Vu
(74) *Attorney, Agent, or Firm*—Wei Te Chung

(57) ABSTRACT

An electrical connector (1) is mounted on a printed circuit board (2) of a device and exposed to outsides of the device from a window (30) of the outer enclosure (3) of the device. The connector (1) has a housing (10) with a plurality of paired signal contacts (12) and ground contacts (13) installed alternately therein. A latch receiver (16) is received in a cavity (104) formed at one end of the housing (10) to provide the latching mechanism when the connector (1) is mated with a complementary connector (4) having the corresponding latch (41) to lock on the latch receiver (16). The latch receiver (16) further comprises a locking portion (163) with a hook end extending beyond the outer enclosure (3) of the device so that the hook end can reach the rim of the window (30) and lock thereon to move the outer enclosure (3) close enough to the front shell (14) of the connector (1) and a gasket (15) placed in front of the front shell (14). The gasket (15) then can engage with the outer enclosure (3) and the front shell (14) of the connector (1) at the same time to establish well EMI protection for the device.

7 Claims, 13 Drawing Sheets

ELECTRICAL CONNECTOR

CROSS REFERENCE TO RELATED APPLICATIONS

The present application claims domestic priority under 35 U.S.C. .sctn. 119(e) from the prior U.S. provisional application Series No. 60/416,331, filed on Oct. 3, 2002, entitled "ELECTRICAL CONNECTOR". The disclosure of the above identified application is incorporated herein by reference.

BACKGROUND OF THE INVENTION

1. Field of the Invention

The present invention is related to an electrical connector having a latching receiver used to latch a complementary connector when the complementary connector, which is always with cables, is mated with the electrical connector, especially to an electrical connector having a latching mechanism that affixes the connector to the panel of an outer enclosure of a device and latch of a complementary connector at the same time.

2. Description of the Related Art

Due to continuing trends toward miniaturization and improved high electrical performance in the electronics industry, electronic devices, like personal computers, servers, work stations, communication equipments and consumption appliances etc., need to be highly integral for a firm installation in the limited internal space of the devices and well EMI protected to achieve the best performance. It is understood there is not enough internal space for the devices to contain all of the existing or known functional parts. Besides, it is advantageous to end users to be able to order an electronic device according to their choice or special need. Therefore, some devices, like personal computers, design available space to install functional extension cards inside the devices so as to enhance the function of the devices. Sometimes, both the motherboard and extension cards used inside of the devices may have connectors mounted thereon for electrical connection to peripheral machines, such as printers, plotters or monitors etc., and other electronic devices to form a network. These input/output (I/O) connectors, however, should be electrically mounted on the motherboard or extension cards and expose their mating interfaces to outside of the devices at the same time. To facilitate exposition of these interfaces, a window is cut into the outer enclosure of one device or a panel mounted on one edge of the extension card for assembling with the outer enclosure of the device to allow the interface portion of each connector passing through the window and staying therein. Usually, the size of the window is almost same as the mating interface portion of a connector so that the metal outer enclosure or panel can engage with or be placed very closely to the front shell of the connector, which is usually a metal structure as well, to establish a better EMI shielding situation for the internal parts of the electronic device.

However, an undesired gap may unavoidably exist because the size of window should be a little bigger than the mating interface of the connector for the convenient installation of the connector. And another gap problem may be caused because any connector mounted on the motherboard or daughter extension cards is spaced from the outer enclosure or panel due to the imprecise mounting position of the motherboard or daughter extension cards in the device. The first gap problem can be easily solved by expanding the front shell of the connector comparing to the size of the window or decreasing the latter. But the second gap problem is more difficult to overcome. One solution is adding an EMI gasket disposed in front of the front shell of the connector. The gasket is a frame-like metal piece with a plurality of flexible severed fingers formed on its edges. When the connector is mounted to the outer enclosure of the device or panel of the daughter extension card so as to expose its interface out of the corresponding window, the gasket then is located between the front shell of the connector and the outer enclosure or panel with all its fingers engaging with the front shell and the outer enclosure or panel at the same time. But sometimes, the gap due to imprecise placement is so large that the flexible fingers of the gasket cannot engage continuously with or be deflected by either the front shell of the connector or the outer enclosure or panel. The improper engagement of the gasket fingers causes the gasket to fail in its role and results in an undesirable noise problem.

SUMMARY OF THE INVENTION

Therefore, the objective of the present invention is to provide an electrical connector having latch receivers with a latching mechanism to fix the connector to a panel or outer device enclosure where the interface of the connector is exposed so as to minimize or eliminate a possible gap between the connector and the panel or outer device enclosure and establish the better EMI protection for the device where the connector is installed.

Another objective of the present invention is to provide an electrical connector that employs the function of latching to a complementary connector while at the same time has an improved latching system that affix the connector to the outer enclosure of a device or a panel to save space which may need for another independent part and facilitate the manufacturing of the connector.

Another objective of the present invention is to provide an electrical connector having an improved latch system which is adjustable to overcome the gap problem which may vary due to the installation position of a printed circuit board where the connector is seated in a specialized device.

Another objective of the present invention is to provide an electrical connector having an improved latch system that affix the connector to the outer enclosure of a device or a panel and the affixing situation of the latch system is able to be assured by portions of a complementary connector when the electrical connector is mated with the complementary connector.

To obtain the above objects, an electrical connector in accordance with the present invention is mounted on a printed circuit board of a device and partially exposed to outsides of the device from a window of the outer enclosure of a device. The connector has a housing with a plurality of paired signal contacts and ground contacts installed alternately therein. A latch receiver is received in a cavity formed at one end of the housing to provide the latching mechanism when the connector is mated with a complementary connector having a corresponding latch to lock on the latch receiver.

Also, the latch receiver further comprises a locking portion with a hook end that extends beyond the outer device enclosure or panel so that the hook end can reach the rim of the window and become latched thereon to move the outer enclosure close enough to the front shell of the connector and the gasket placed in front of the front shell. The gasket then can engage with the outer enclosure and the front shell of the connector at the same time to establish a solid EMI protection for the device.

In addition, the locking portion of the latch receiver is made integrally with the latch receiver or, on the contrary, made independently as an attachment of the latch receiver. And the locking portion of the latch receiver can become latched on the outer enclosure of a device by being actuated automatically or manually. The accessible and variable actuation features of the locking portion can simplify the structural design of the connector to save installation space and facilitate the manufacture of the connector. Besides, the final latching position of the locking portion provides adjustability in order to overcome different sizes of the possible gaps between the front shell of the connector and the outer enclosure of the device. Meanwhile, the mating portion of the complementary connector will provide back support when the electrical connector is mated with the complementary connector to prevent the locking portion from release out of the outer enclosure of the device or a panel.

Other objects, advantages and novel features of the invention will become more apparent from the following detailed description of the present embodiment when taken in conjunction with the accompanying drawings.

BRIEF DESCRIPTION OF THE DRAWINGS

FIG. 13A shows the locking portion deflected after passing through the window and FIG. 13B shows the locking portion snapped open and hooked over the window opening of the outer device enclosure or panel.

DESCRIPTION OF THE PREFERRED EMBODIMENT

Figure 1:
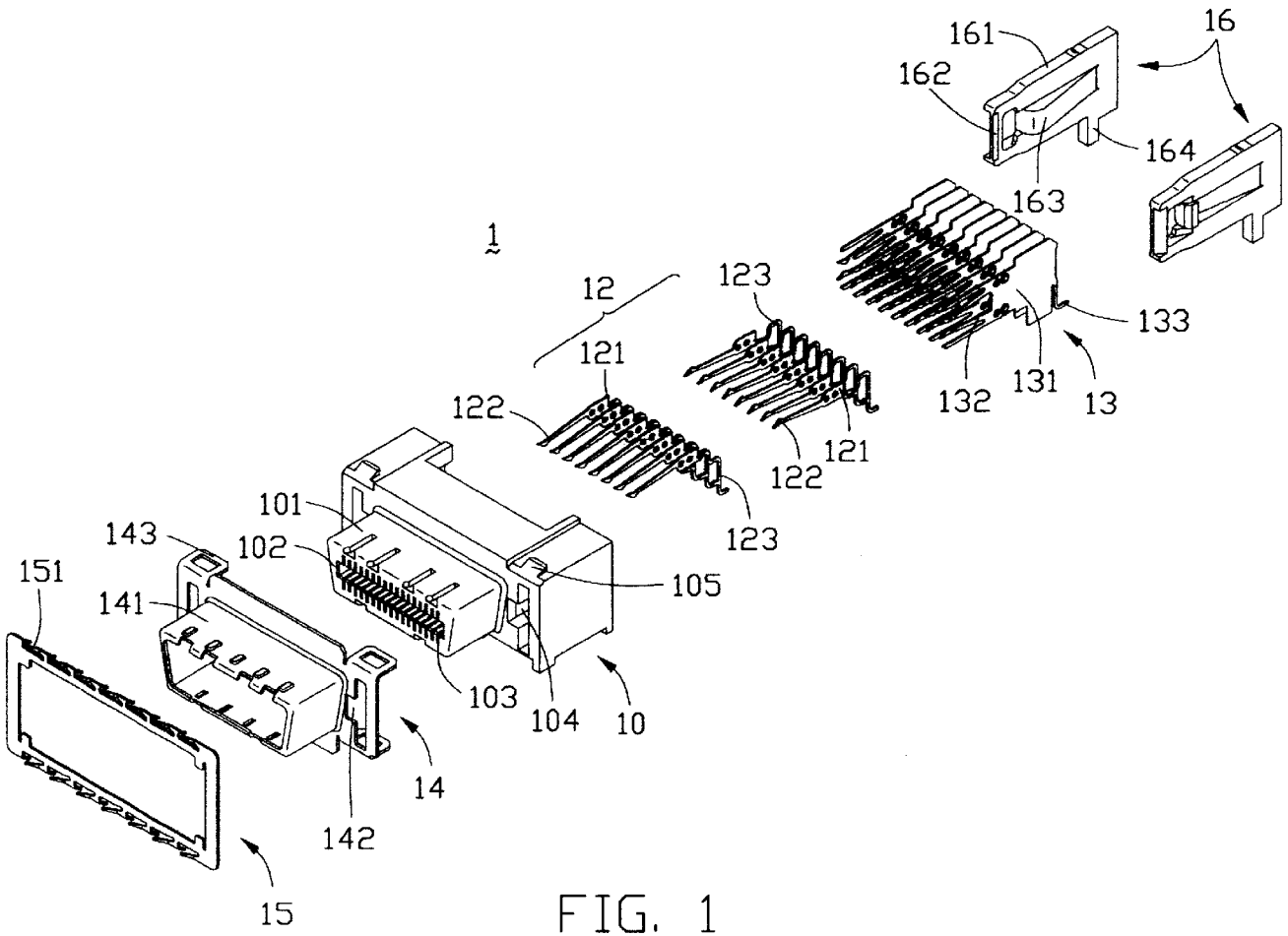
FIG. 1 is an exploded view of an electrical connector in accordance with present invention.

Referring to FIG. 1, an electrical connector 1 in accordance with the present invention is shown. The receptacle type input/output (I/O) electrical connector 1 includes a housing 10 with a D-shaped mating protrusion 101 extending from one side of the housing 10. A mating groove 102 is formed on the distal end face of the protrusion 101, and a plurality of channels 103 arranged in a row is formed on each of two opposing sidewalls of the groove 102 and each channel extends through the housing 10 so as to communicate with the opposing side of the housing 10. Two cavities 104, each of which is located at one end of the housing 10, has an opening formed at the same housing side where the protrusion 101 is formed and extends through the housing 10 to have the other opening formed at the opposing side of the housing 10. The cavities 104 have an identical T-shaped cross section. At least two projections 105 are formed on the top and bottom faces respectively.

A plurality of signal contacts 12, usually arranged in an upper and a lower row, are installed in the channels 103 respectively. Each contact 12 in the upper row is paired with a corresponding contact 12 in the lower row, and both of them are respectively installed in two channels 103 formed on different sidewalls of the groove 102 and arranged in an imaginary plane perpendicular to the lengthwise direction of the housing 10. The paired contacts 12 are installed into the corresponding channels 103 to have their engaging portions 122 partially staying in the mating groove 102 and facing to each other. A retention portion 121 of each contact 12 is formed in the middle of the contact with at least one barb extending therefrom so as to fix the contact 12 inside the corresponding channel 103 when the contact 12 is inserted therein. A tail portion 123 extending from the retention portion 121 of the contact 12 toward the bottom face of the housing 10 is used to be surface mounted on a motherboard 2 or a daughter extension card (shown in FIG. 2) of an electronic device like a personal computer. Besides, a plurality of ground contacts 13 is installed in the alternated channels 103 between the channels 103 where the signal contacts 12 are installed. Each ground contact 13 has a body portion 131 residing in and fixed between two channels 103 formed on different sidewalls of the groove 102 and located in an imaginary plane next to the imaginary located plane of one pair of the paired signal contacts 12 when the ground contact 13 is inserted into the housing 10. A fork-like engaging portion 132 extends from one side of the body portion 131 and its two distal ends are exposed in the groove 102 when the ground contact 13 is installed. A tail portion 133 extending from the opposing side of the body portion 131 is formed toward the bottom face of the housing 10 so as to be used for soldering on a printed circuit board.

A front shell 14, as one of the EMI protectors in front of the housing and stamped from a metal sheet, has a D-shape shroud 141 projecting from one side of the front shell 14. Two T-shaped hole 142 are formed at lengthwise ends of the front shell 14 respectively and located at two opposing side of the shroud 141. Tabs 143 with a hole formed thereon are formed on the top and bottom edge of the front shell 14 and extend along the opposing direction reversed to the projecting direction of the shroud 141. The front shell 14 is disposed at the side of the housing 10 where the mating protrusion 101 is formed and the mating protrusion 101 is inserted and surrounded by the shroud 141 when the housing 10 and the front shell 14 are put together. Tabs 143, each of which has a disposed location corresponding to one of the projections 105 of the housing 10, are latched on the corresponding projections 105 to fix the whole front shell 14 thereon. Each hole 142 of the front shell 14 is then aligned with the opening of one corresponding cavity 104 of the housing 10. The connector 1 can further comprises a gasket 15 as the EMI protector. The gasket 15 is stamped from a metal sheet and has a ring-like frame. A plurality of lanced flexible fingers 151 is disposed on every necessary outer edge of the gasket 15 if they help promoting EMI protection.

A latch receiver 16 is installed in each of two cavities 104 of the housing 10. The latch receiver 16 has a stamped or die-cast body 161 with retention barbs formed thereon to fix the latch receiver 16 in the corresponding cavity 104. A receiving portion 162 with a central hollow is formed at one distal end of the latch receiver 16 and a hook-like locking portion 163 is severed from the central area of the body 161. The locking portion 163 is slightly bent aside and is held in position by friction so that the hook tip end of the locking portion 163 can be flushed with one side surface of the body 161 rather than projecting therefrom. The friction to hold the locking portion 163 is provided by either swelling material from the body 161 toward the locking portion 163 or the opposite. The hook end of the locking portion 163 and the receiving portion 162 extend beyond the mating side face of the housing 10 when the latch receiver 16 is installed inside the cavity 104. A tail portion 164 extends from the bottom edge of the body 161 and is connected to a printed circuit board if it is needed.

Figure 2:
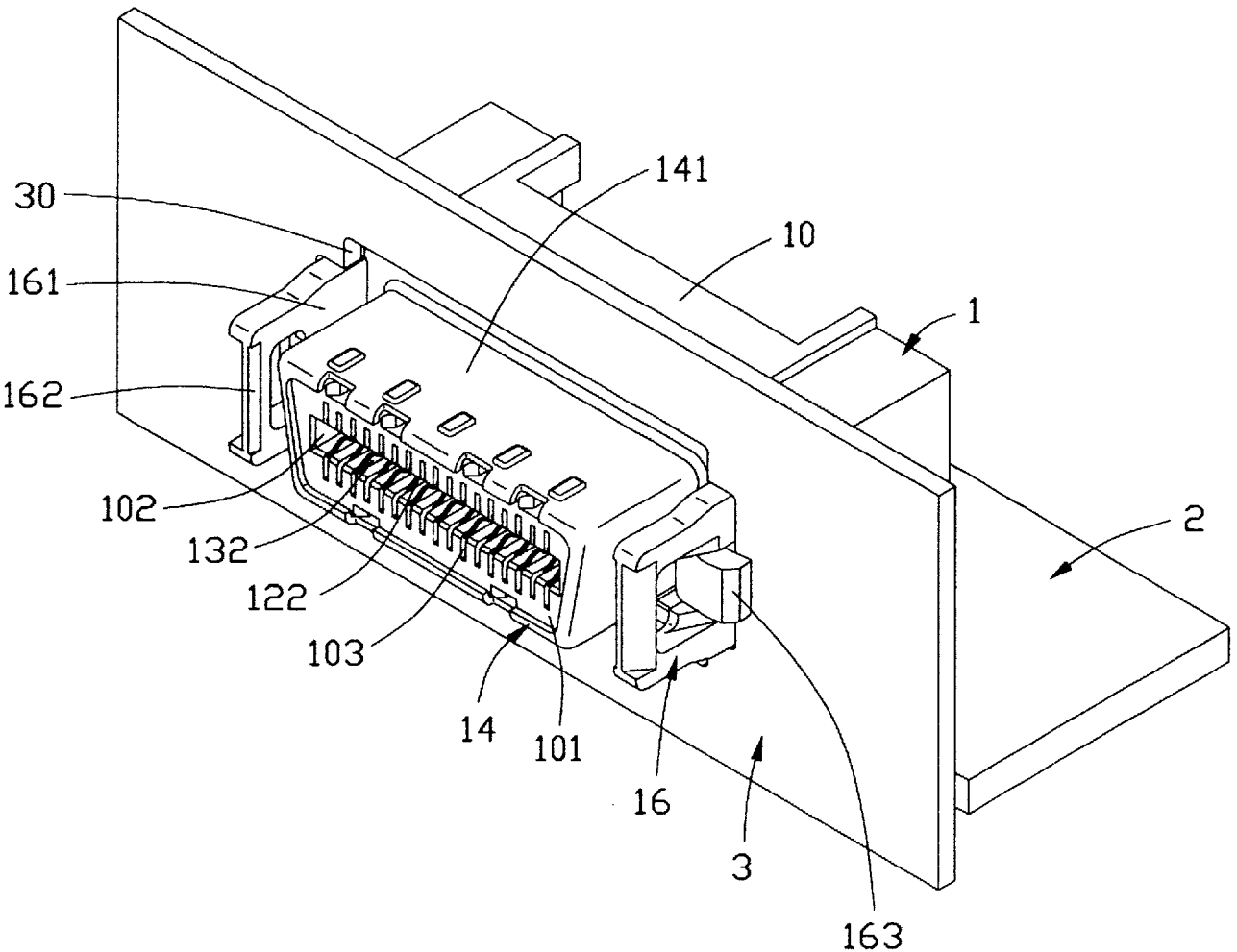
FIG. 2 is a perspective view of the electrical connector as shown in FIG. 1 in accordance with the present invention showing the connector mounted on a printed circuit board and placed near a panel or outer device enclosure.
Figure 3:
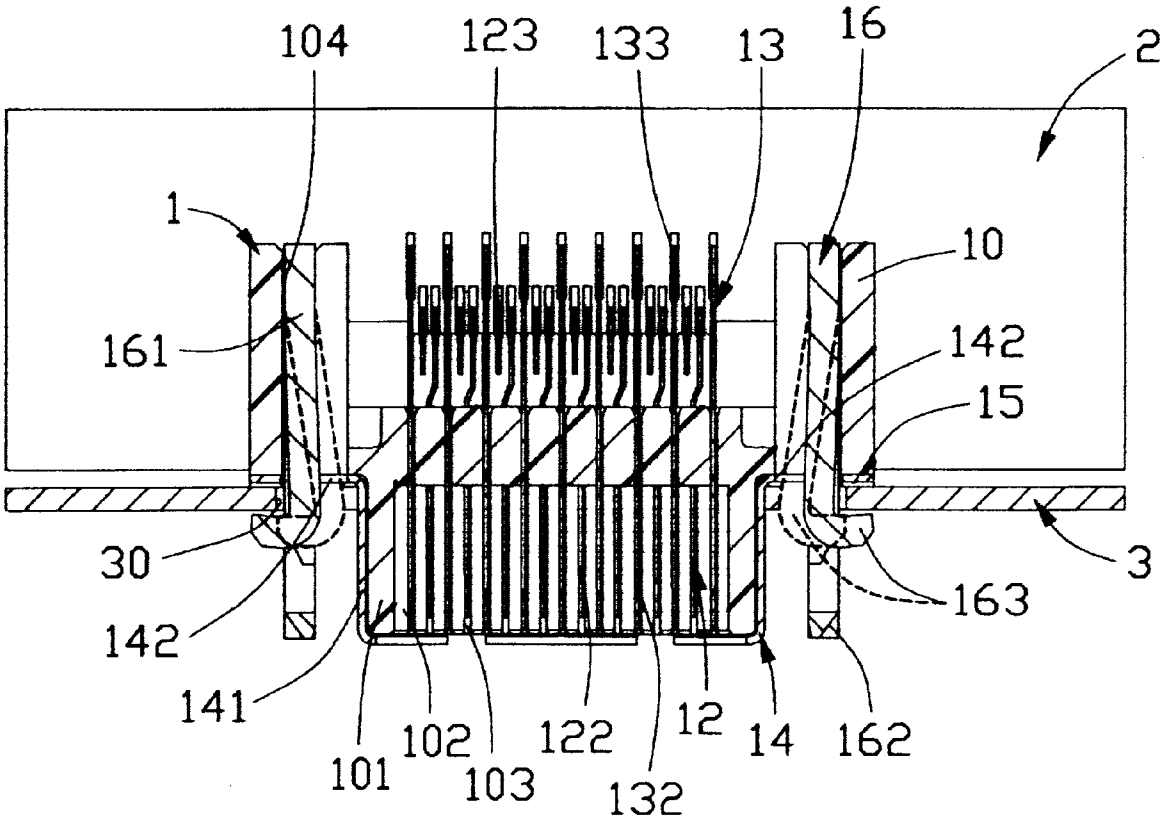
FIG. 3 is a sectional view of the electrical connector showing the relationship between its latch receiver and the panel or outer device enclosure in FIG. 2.
Figure 4:
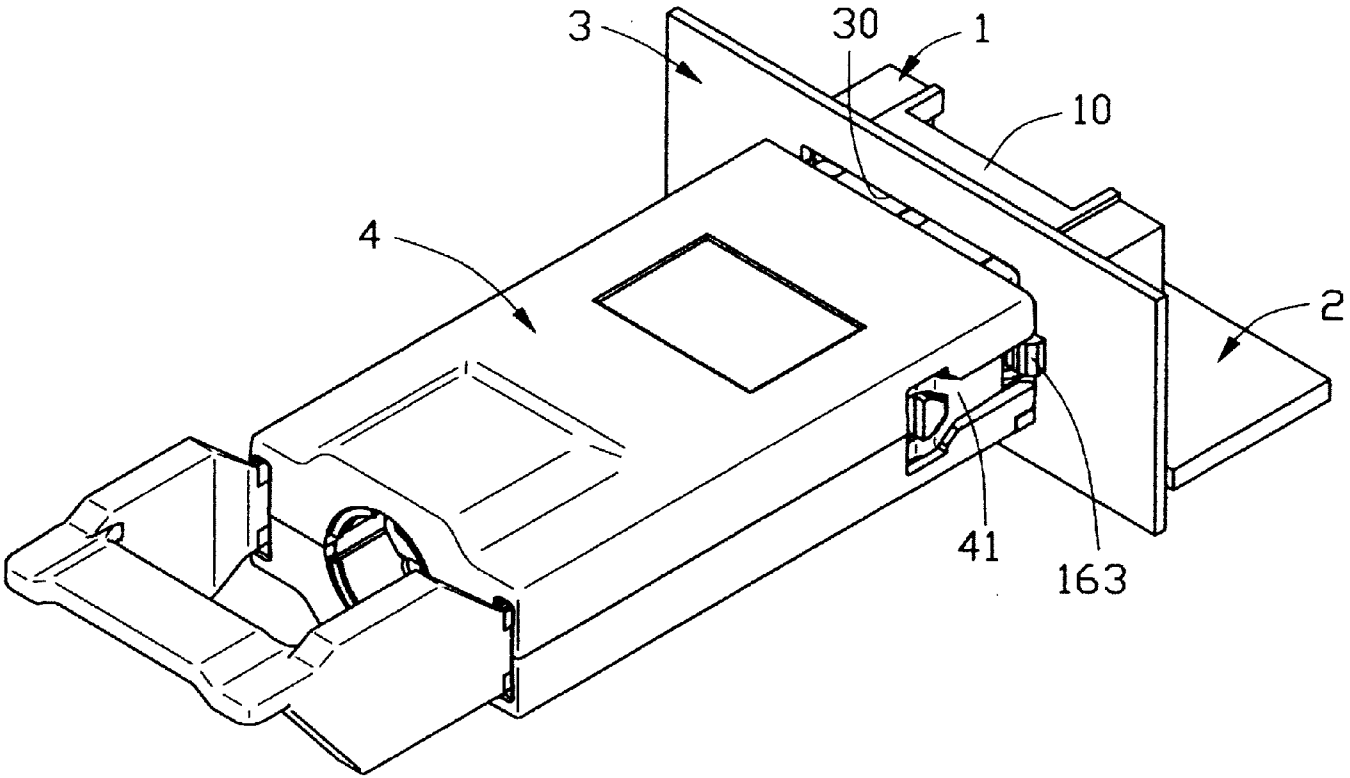
FIG. 4 is a perspective view of the electrical connector as shown in FIG. 1 in accordance with the present invention and its mated complementary plug connector.
Figure 5:
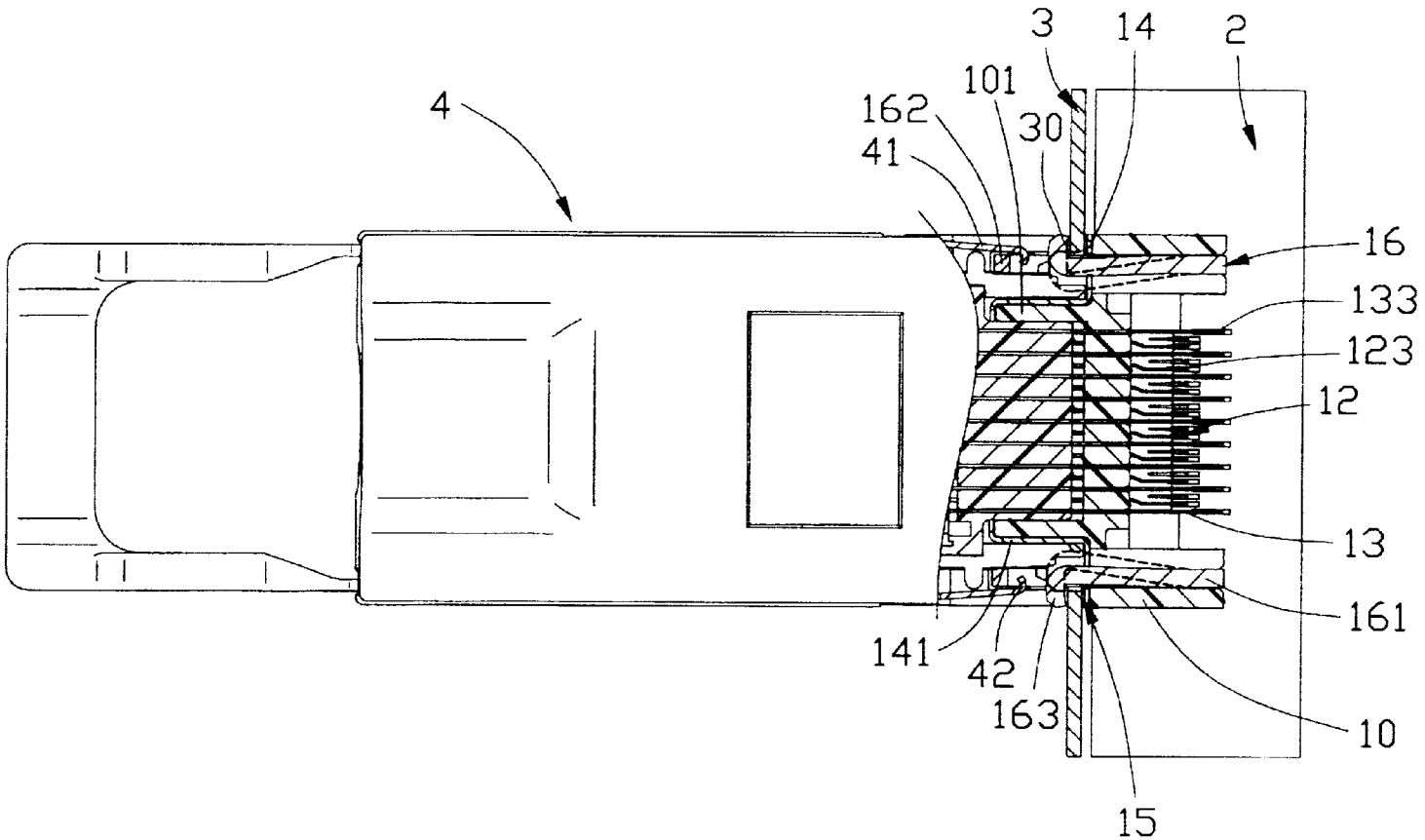
FIG. 5 is a sectional view of the electrical connector showing the relationship between its latch receivers, the corresponding latches of the complementary connector and the panel or outer device enclosure in FIG. 4.

Referring to FIGS. 2 and 3, when the connector 1 is assembled and mounted onto a motherboard 2 or a daughter extension card, the signal contact pairs 12 and ground contacts 13 are installed into the corresponding channels 103 of the housing 10 alternately to have their engaging portions 122, 132 extending in the mating groove 102 in order for forming the mating interface of the connector 1. And the front shell 14 is disposed around the mating protrusion 101 of the housing 1 to provide EMI protection. The latch receivers 16, each of which is installed in one cavity 104 of the housing 10, have their receiving portion 162 and the hook end of the locking portion 163 passing through the cavity 104 and the corresponding hole 142 of the front shell 14 successively so as to project beside the mating protrusion 101. After the connector 1 is mounted onto the motherboard 2 by soldering the needed tail portions 123, 133, 164 of the signal contacts 12, ground contacts 13 and latch receivers 16 to pads or plated through holes formed on the motherboard 2, the connector 1 is installed through the outer enclosure 3 of an electronic device accompanying with the mounting process of the motherboard 2. Due to the preset dimensions, the mating protrusion 101 and projecting portions of the latch receiver 16 all pass through a window 30 formed in the outer enclosure 3 or the panel of the daughter extension card and are just snug therein. The EMI gasket 15 placed in front of the front shell 14 before the installation is then engaged with the inner surfaces of the outer enclosure 3 surrounding the window 30 and the front area of the front shell 14 around the mating protrusion 101 at the same time. After the connector passes through the window 30 of the outer enclosure 3, the hook end of the locking portion 163 of every latch receiver 16 reaches to the rim of the window 30 and extends beyond the outer enclosure 3. Thereafter, a tool like a screwdriver can be used to drive the hook end and the whole severed locking portion 163 to move aside from its frictionally held state so as to engage with the rim of the window 30 and lock thereon, and thereafter be held in the locked position frictionally. Meanwhile, the locking force provided by the hook end of the locking portion 163 is applied on the surface of the outer enclosure 3 and makes the outer enclosure 3 becoming closer to the EMI gasket 15 to minimize any possible gap formed therebetween and solve the noise problem of conventional designs. Referring further to FIGS. 4 and 5, a complementary connector 4, usually a plug one with cables attached thereto, is then mated with the connector 1 when the device is going to transmit signals to other devices. The complementary connector 4 has flexible latches 41 formed at two opposing sides of its mating portion respectively and each latch 41 has a hook-like head 42 can be locked on the receiving portion 162 of one latch receiver 16 of the connector 1 so as to guarantee reliable, effective mating engagement of the connector 1 and the complementary connector 4 and avoid these two connectors 1, 4 from any sudden disconnection caused by accidentally pulling force applying on the cable of the complementary connector 4. Obviously, the mating portion of the complementary connector 4 will block the original position of the locking portion 163 and become a back support of the locking portion 163 due to the engagement of the connector 1 and the complementary connector 4 so as to prevent any sudden release of the locking portion 163 from the outer enclosure 3 or panel.

Figure 6:
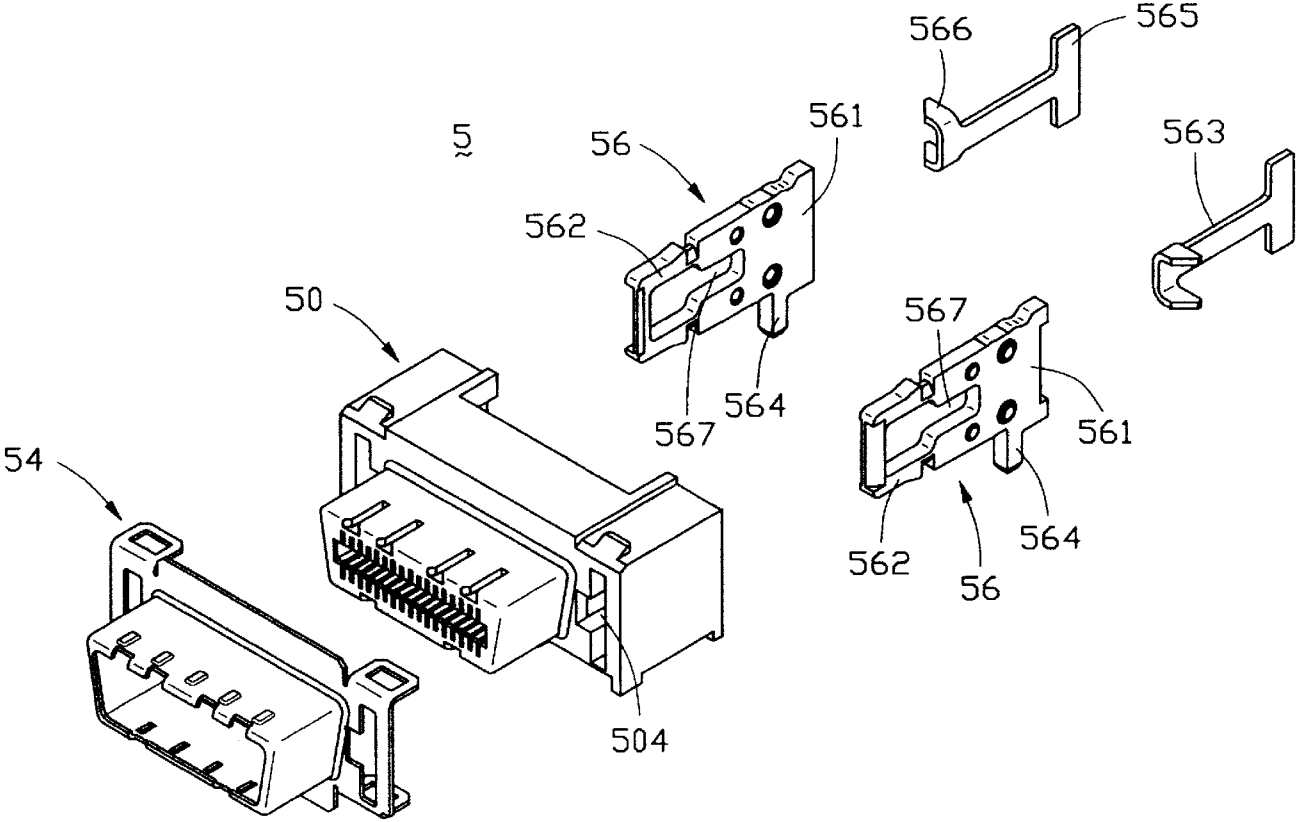
FIG. 6 is a partially exploded view of an electrical connector in accordance with a second embodiment of the present invention.
Figure 7:
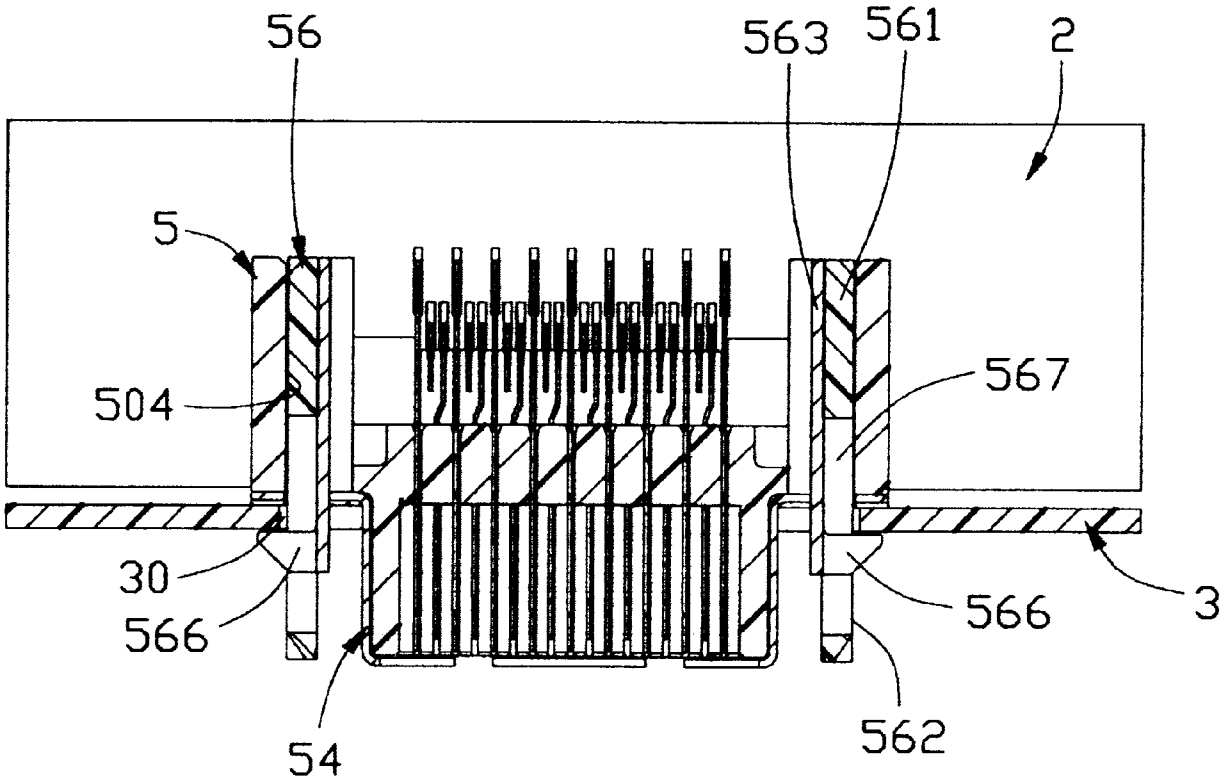
FIG. 7 is a sectional view of the electrical connector showing the relationship between its latch receivers and the panel or outer device enclosure in FIG. 6.

Referring to FIGS. 6 and 7, a second embodiment of the electrical connector 5 in accordance with the present invention is shown having a different locking mechanism from the first embodiment. The housing 50, conductors installed inside the housing 50 and the front shell 54 attached to the housing 50 are remained the same as the first embodiment mentioned above. A latch receiver 56 is installed in every T-shaped cavity 504 formed at one of the ends of the housing 50. The latch receiver 56 has a die-casting body 561, a receiving portion 562 with a central hollow formed thereon and a tail portion 564, which all have the same configurations and functions as the ones shown in the first embodiment. However, a separate flexible locking portion 563 is used and has a retention end 565 and a hook end 566 formed at two different ends of the locking portion 563 respectively. The locking portion 563 is placed beside the body 561 of the latch receiver 5 and abutting against the side surface of the body 561. An extra notch 567 communicating with the central hole of the receiving portion 562 is formed to provide space for the hook end 566 of the locking portion 563 staying therein when the locking portion 563 is installed into the cavity 504 accompanying with the body 561 of the latch receiver 5. Therefore, when the connector 5 is mounted on a printed circuit board 2 and disposed on the outer enclosure 3 of the device, the resilient locking portion 563 can be locked on the rim of the window 30 of the outer enclosure 3 automatically due to the flexibility of the locking portion 563 and the movement of the hook end 566 caused by the locking portion 563 while the locking portion 563 passes through the window 30 of the outer enclosure 3. Enough locking force is provided for the EMI gasket 55 too and well EMI protection of the device can be established.

Figures 8A, 8B, 8C, 8D, 8E:
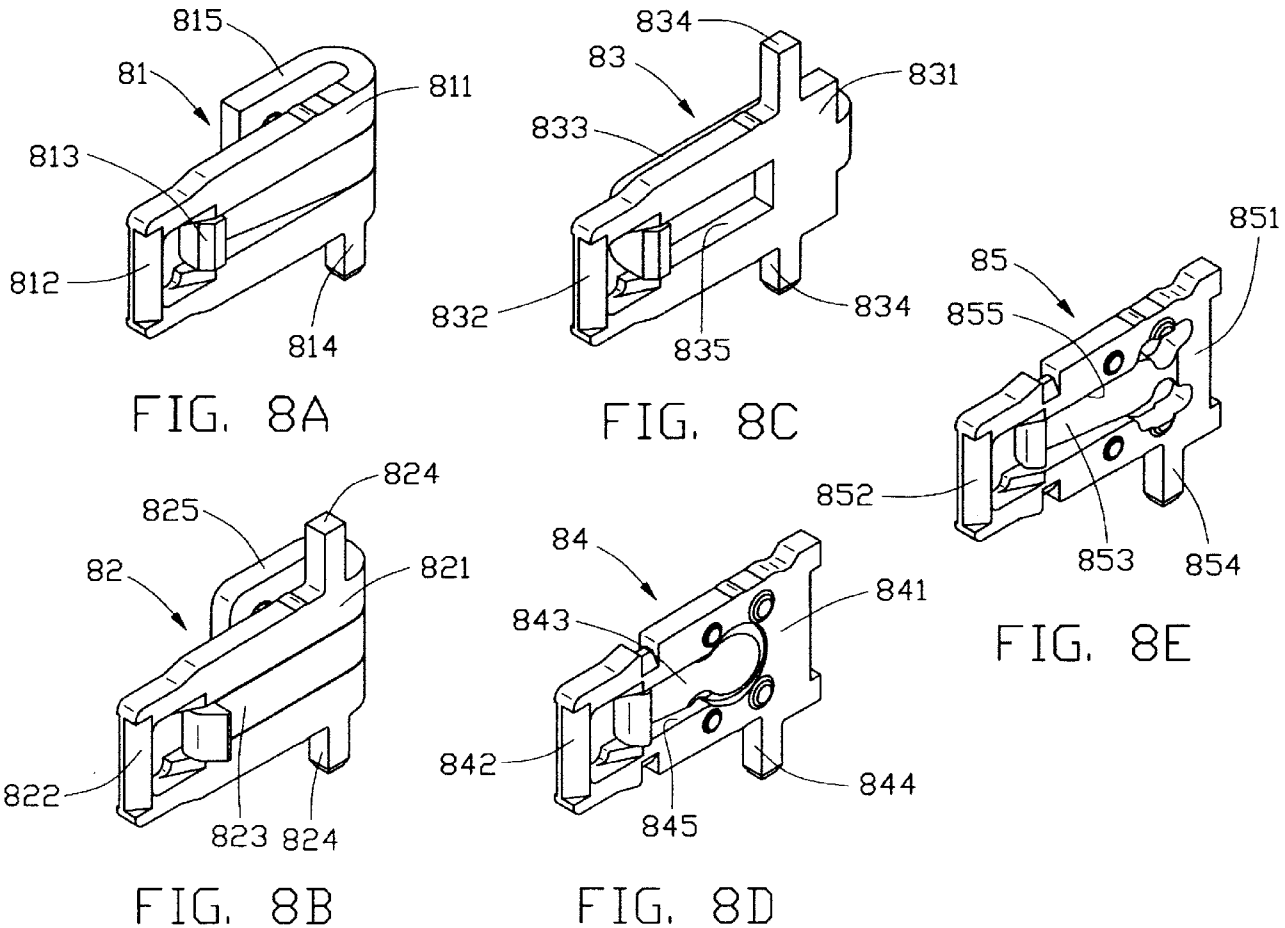
FIG. 8A to 8E are perspective views of other die-cast latch receivers of the electrical connector functioning as shown in FIG. 1 in accordance with other embodiments of the present invention.

Referring to FIGS. 8A to 8E, more embodiments of the latch receivers for the electrical connector in accordance with the present invention are shown to be received in the same cavity of the connector housing and function same as the first or second embodiment. The latch receiver 81 shown in FIG. 8A is almost same as the one of the first embodiment about its body 811, receiving portion 812, locking portion 813 and tail portion 814 except for an additional extension portion 815 for better retention. The additional extension portion 815 extends from the rear edge of the body 811 and is bent reversely so as to be installed in the corresponding cavity of the connector housing. The severed locking portion 813 of the latch receiver 81 can get better flexibility due to the newly added extension portion 815. Another latch receiver 82 introduced in FIG. 8B uses the same body 821, receiving portion 822 and extension portion 825 as the one in FIG. 8A. But two tail portions 824 are symmetrically formed on two opposing edges of the body 821 so that the latch receiver 82 can be installed in any cavity of the connector housing without the concern of orientation. And a severed locking portion 823 is formed in the middle of the body 821 without any offset or bend processing. The hook end of the locking portion 823 then can be latched on the outer enclosure of a device automatically when the connector is mounted. In FIG. 8C, the same body 831, receiving portion 832, tail portions 834 as the one in FIG. 8B can be found, but a locking portion 831 extending integrally with the original extension portion is used and its hook end stays in a notch 835 formed in the central body 831 to be flushed with the side surface of the body 831. In FIGS. 8D and 8E, the similar body 841, 851, receiving portion 842, 852 and tail portion 844, 854 to the first embodiment are used for the shown latch receivers 84, 85. The latch receiver 84 has a separate locking piece 843 disposed snugly in a notch 845 of the central body 841 and moved rotationally about its one disk-like end which is snapped by the surrounding squeezed rims of the notch 845. On the contrary, the latch receiver 85 comprises an integrally formed locking portion 853 similar to the first embodiment and the locking portion 853 has the better flexibility by using a pretty thin end connection with the body 851.

Figure 9G:
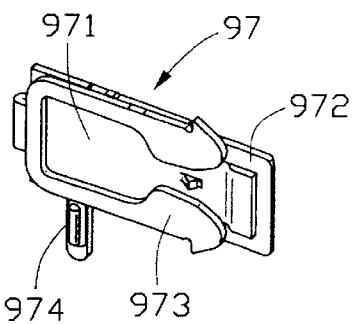
FIG. 9A to 9G are perspective views of other stamped plate-like latch receivers of the electrical connector functioning as shown in FIG. 1 in accordance with other embodiments of the present invention.
Figure 9E:
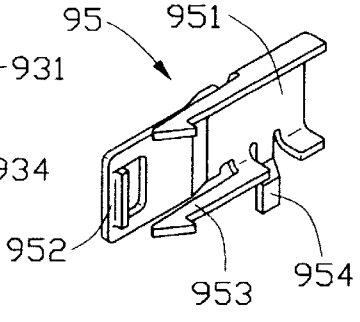
Figure 9C:
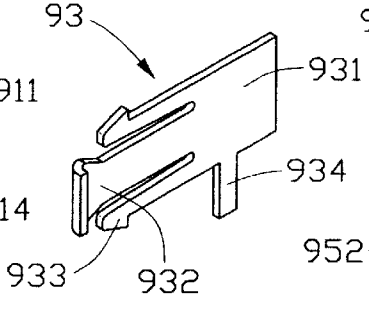
Figure 9A:
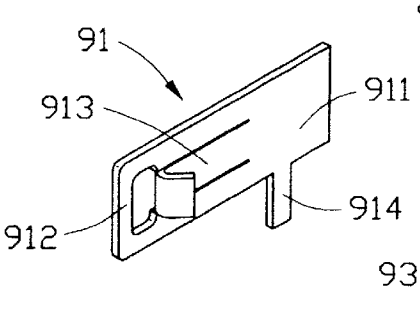
Figure 9F:
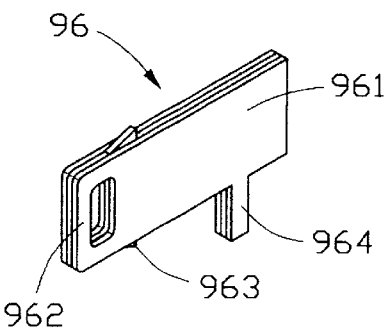
Figure 9D:
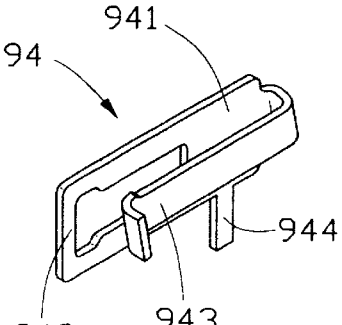
Figure 9B:
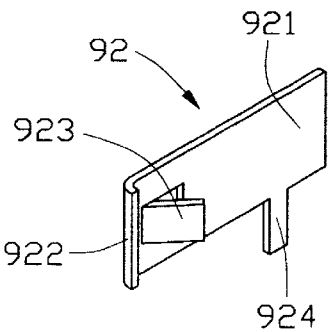

Referring to FIGS. 9A to 9G, more embodiments of the latch receivers for the electrical connector in accordance with the present invention are shown to be received in the same cavity of the connector housing and function same as the first or second embodiment by being formed from a stamped metal sheet. The latch receiver 91 in FIG. 9A has a resilient locking portion 913 severed from its body 911 while the receiving portion 912 and tail portion 914 remain same as the first embodiment. And the latch receiver 92 in FIG. 9B has a specialized lanced-out locking portion 923 and a curved edge-like receiving portion 922 with the same body 921 and tail portion 924 as the ones in FIG. 9A. In FIG. 9C, the latch receiver 93 has a receiving portion 932 like the one in FIG. 9B and two branched locking portions 933 extending from the top and bottom edges of the body 931 with the same body 931 and tail portion 934 as the ones in FIG. 9A. The latch receiver 94 in FIG. 9D comprises a body 941, receiving portion 942 and tail portion 944 as the ones in FIG. 9A, and a reversely extended locking portion 943 bent from the rear edge of the body 941. In FIG. 9E, the body 951 of the latch receiver 95 has two laterally bent edges at its top and bottom portions to form locking portions 953 extending at the front portions of these two edges while its receiving portion 952 and tail portion 954 are similar to the ones in FIG. 9A. In FIG. 9F, the latch receiver 96 has a body 961 with three assembled plates to form a receiving portion 962 and tail portion 964 at its front and bottom portions at the same time. Two protrusions as the locking portion 963 are formed on top and bottom edges of the central plate of the body 961. And finally in FIG. 9G, the latch receiver 97 has a body 971 and tail portion 974 like the ones in FIG. 9A and a receiving portion 972 comprising a lanced-out in the central area. A reversely bent U-shaped locking portion 973 abuts against the body 971 and forms two hook-like branch ends.

Figure 10:
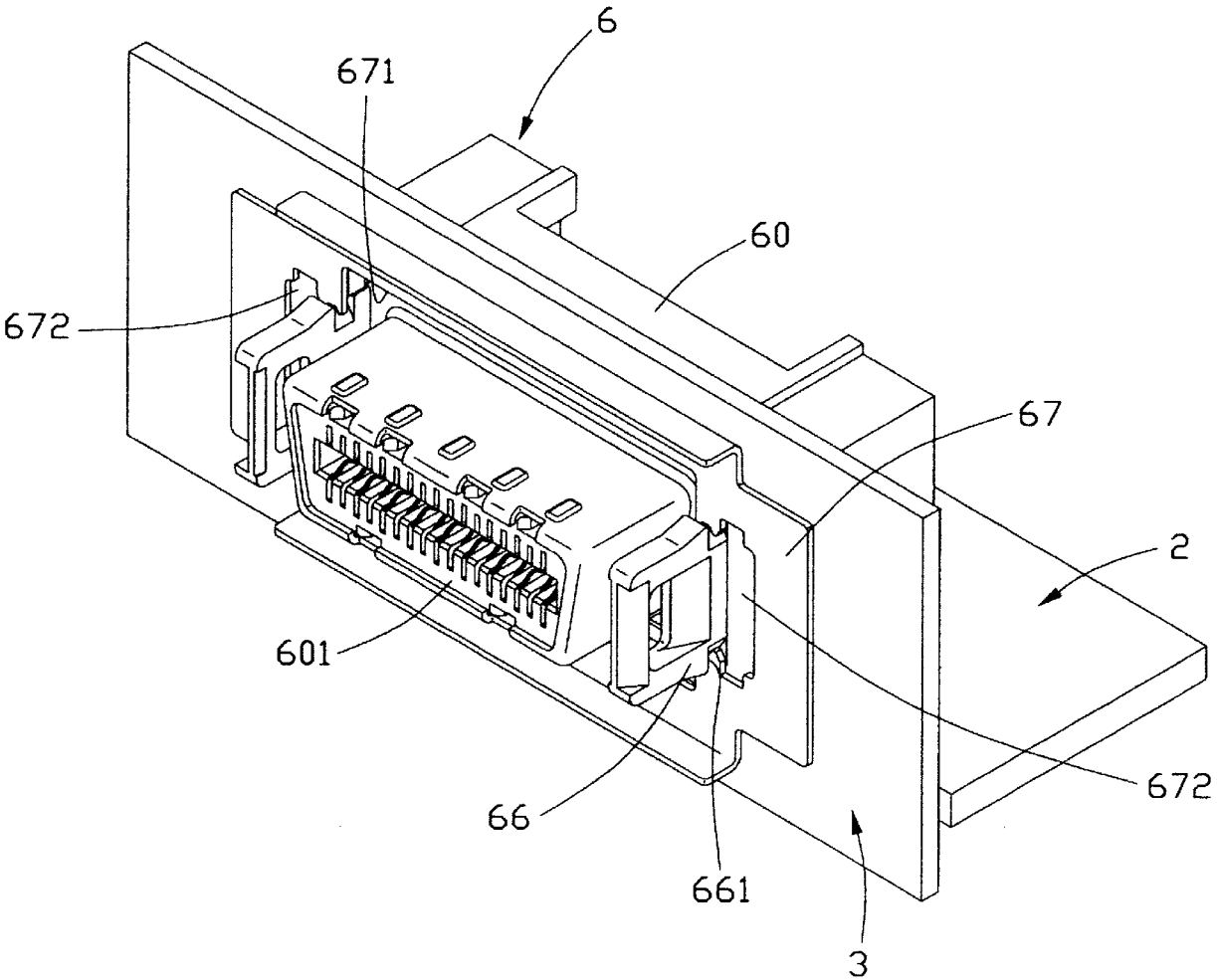
FIG. 10 is a perspective view of an electrical connector in accordance with another embodiment of the present invention being mounted on a printed circuit board and placed near a panel or outer device enclosure.

Referring to FIG. 10, a third embodiment of the electrical connector in accordance with the present invention is shown having a different locking mechanism from the first embodiment. A frame-like slider 67 having a central window 671 and two notches 672 formed near two opposing sides of the window 671 to communicate with the window 671 is installed around the mating protrusion 601 of the housing 60 and latch receivers 66 when the connector 6 of the third embodiment is mounted on the motherboard 2 and outer enclosure 3 of a device. Two indentations 661 are formed on the top and bottom edges of every latch receiver 66. The slider 67 can be latched in the indentations 661 of latch receivers by means of the rims of notches 672 while the slider is moved aside after the protrusion 601 and one of the latch receivers 66 pass through the window 671 of the slider 67 and the other latch receiver 66 passes through one notch 672 of the slider 67 so that the slider is able to be installed in position. Besides, in the condition of multiple connectors being mounted on the motherboard 2 and arranged in a line, a common slider can be used to install on latch receivers of these connectors at the same time to shorten the necessary process and operating time.

Figure 11:
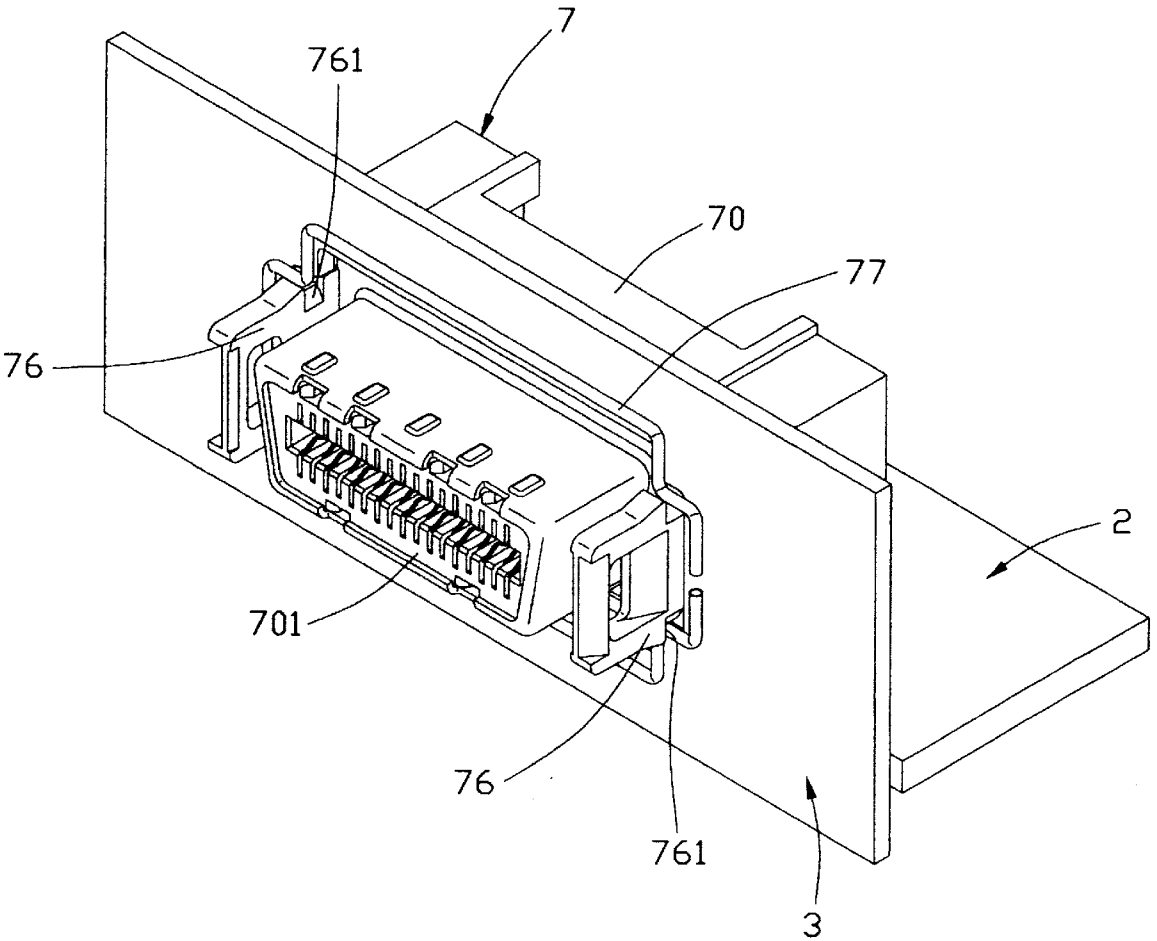
FIG. 11 is a perspective view of an electrical connector in accordance with another embodiment of the present invention being mounted on a printed circuit board and placed near a panel or outer device enclosure.

Referring to FIG. 11, a fourth embodiment of the electrical connector in accordance with the present invention is shown. A wire-made holder 77 is installed around the mating protrusion 701 of the housing 70 and latch receivers 76 when the connector 7 of the fourth embodiment is mounted on the motherboard 2 and outer enclosure 3 of a device. The flexible wire of the holder 77 can be stretched wider to fit itself snugly around the protrusion 701 and latch receivers 76 to latch thereon by letting portions of the holder 77 staying in indentations 761 formed on the top and bottom edges of two latch receivers 76. Except for these two embodiments, a separate plastic locking portion integrally formed on the connector housing is useful to lock on the outer enclosure and can be a feasible embodiment too.

Figure 12:
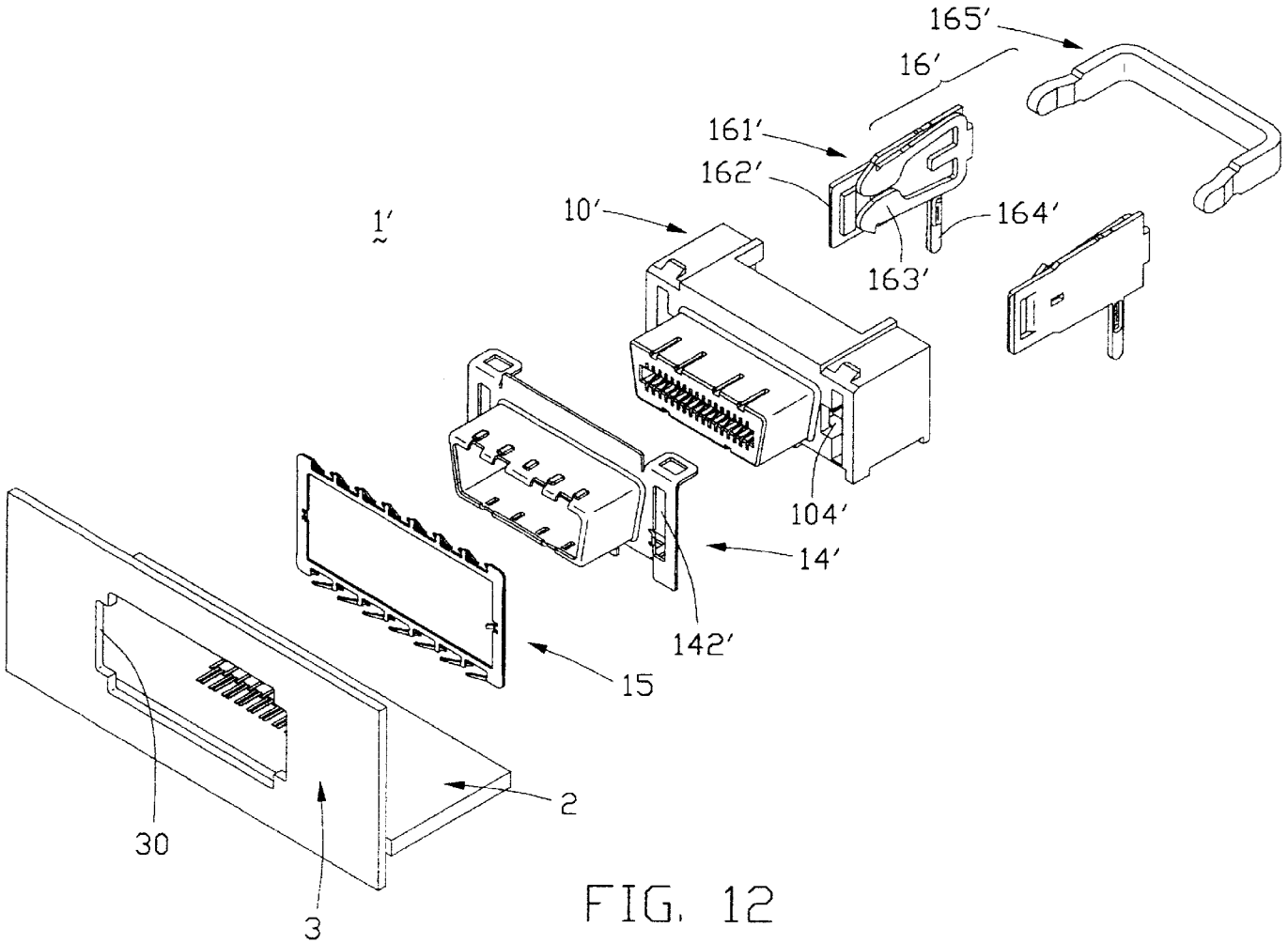
FIG. 12 is an exploded view of another embodiment of the electrical connector in accordance with the present invention showing the electrical connector is going to be mounted on a printed circuit board and placed near a panel or outer device enclosure.
Figure 13B:
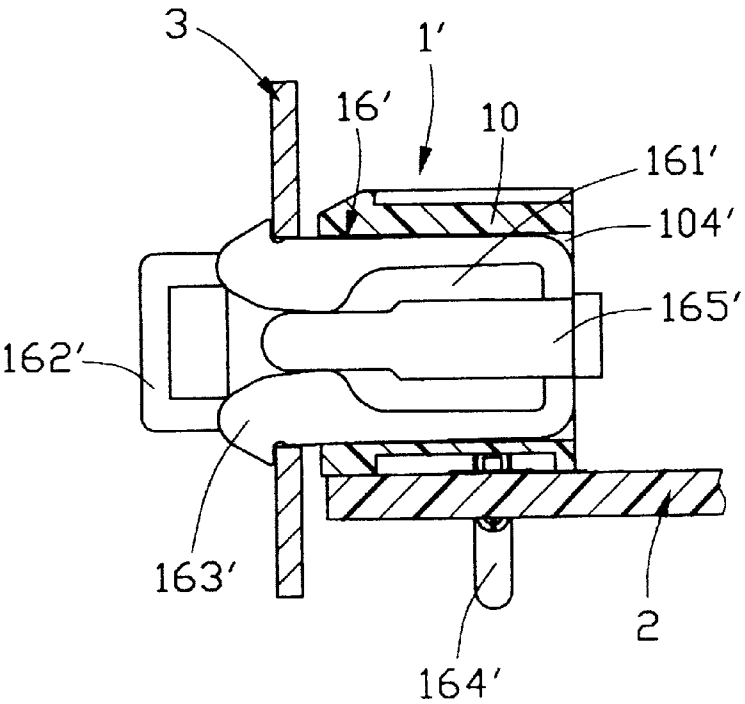
FIGS. 13A and 13B are sectional views of the electrical connector shown in FIG. 12 about movement of the locking portion of the latch receiver after passing through the window of the outer device enclosure or panel.
Figure 13A:
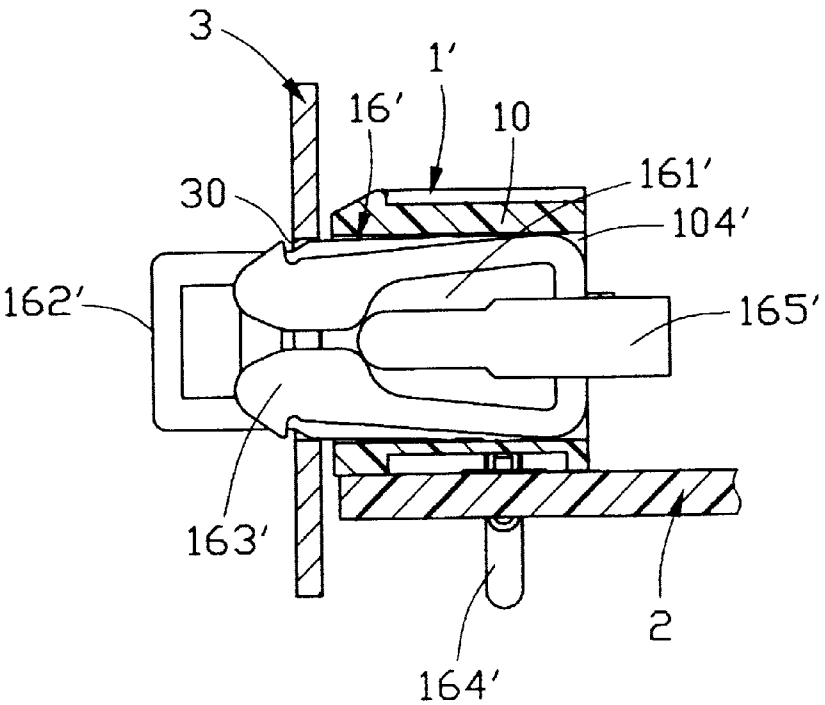

Referring to FIGS. 12 and 13A, 13B, a fifth embodiment of the electrical connector in accordance with the present invention is shown having a locking mechanism similar to the first embodiment. The latch receiver 16' of this embodiment has a body 161 ' and tail portion 164' like the ones of the first embodiment and a receiving portion 162' comprising a lanced-out in the central area to provide room for the latch of the complementary connector (not shown). A reversely bent U-shaped locking portion 163' extends abutting against the body 161 ' and forms two hook-like branches with their hook ends being flushed with the nearest side edges of the body 161'. A U-shaped join piece 165' having an offset portion formed at every distal end of its U shape is made separately. Each offset portion is placed within a space between the two branches of the locking portion 163' and next to the body 161' so that the offset portion of the join piece 165' can be inserted into one of the cavity 104' of the housing 10' together with the body 161 ' and the locking receiver 163' to stay just behind the hook branches of the locking portion 163'. Thus, after two bodies 161' of the latch receiver 16' are installed into the cavities 104' of the housing 10' and their receiving portions 162' extend out of the cavities and holes 142' of the front shell 14', the join piece 165' can be held behind the housing 10' due to its two inserted offset portions. The join piece 165' can be used to provide more union ground paths to shorten the needed ground distance for all metal ground pieces like the front shell 14', bodies 161' of the latch receiver 16' so as to achieve better electronic performance. And the join piece 165' can be pushed toward the housing 10' to make its offset portions moving forward to interpose themselves between two branches of the locking portions 163' after the connector 1' is mounted on a printed circuit board 2 and an outer device enclosure 3 so as to move the branches of the same locking portions away from each other and have the hook end of every branch reaching the rim of a window 30 of the outer enclosure 3 and becoming locked thereon.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an electrical connector unit including:

an insulative housing defining a mating port with a plurality of contacts therein;

a metal shield enclosing at least a front portion of the housing;

at least one latch receiver extending forwardly by one side of the mating port;

a metallic panel located in front of the connector, said panel defining an opening in alignment with the mating port along a front-to-back direction; and a resilient metal gasket sandwiched between the panel and the shield; wherein said latch receiver includes a cable end connector latching section adapted to cooperate with a latch of a complementary cable end connector to secure the connector unit and the complementary cable end connector together, and a panel securement section to efficiently grasp the panel in the front-to-back direction so as to have the resilient gasket abut against both the panel and the shield oppositely and respectively; wherein said connector unit includes at least one holding section to temporarily pre-assemble the gasket to the connector in a loose manner before the latch receiver is secured to the panel for convenient assembling or delivery; wherein said holding section is formed on the latch receiver; wherein said latch receiver extends though said panel in the front-to-back direction.

2. The assembly as described in claim 1, wherein the panel securement section is somewhat resilient, in comparison with other portions of the latch receiver, for easy attachment to the panel.

3. The assembly as described in claim 1, wherein the mating port extends forwardly through the opening for coupling with the complementary cable end connector.

4. The assembly as described in claim 3, wherein said gasket essentially surrounds said mating port.

5. The assembly as described in claim 1, wherein said cable end connector latching section is located in front of the panel securement section.

6. The assembly as described in claim 1, wherein said panel securement section is integrally formed on said latch receiver.

7. The assembly as described in claim 1, wherein said latch receiver is secured by the housing.

* * * * *